US010231547B2

(12) United States Patent
Choi

(10) Patent No.: US 10,231,547 B2
(45) Date of Patent: Mar. 19, 2019

(54) CONNECTOR FOR SOFA CHAIR FRAME AND SOFA CHAIR FRAME HAVING SAME

(71) Applicant: Anyplace Concepts Co., Ltd., Xiamen (CN)

(72) Inventor: Kwan Jun Choi, Xiamen (CN)

(73) Assignee: Anyplace Concepts Co., Ltd., Xiamen (CN)

( * ) Notice: Subject to any disclaimer, the term of this patent is extended or adjusted under 35 U.S.C. 154(b) by 0 days.

(21) Appl. No.: 15/663,497

(22) Filed: Jul. 28, 2017

(65) Prior Publication Data

US 2018/0027969 A1 Feb. 1, 2018

(30) Foreign Application Priority Data

Jul. 29, 2016 (CN) ..... 2016 2 0811440 U

(51) Int. Cl.

| | |
|---|---|
| ***A47C 4/02*** | (2006.01) |
| ***A47C 1/031*** | (2006.01) |
| ***A47C 13/00*** | (2006.01) |
| ***A47C 17/04*** | (2006.01) |
| ***A47C 17/02*** | (2006.01) |

(52) U.S. Cl.

CPC ..... *A47C 4/022* (2013.01); *A47C 1/031* (2013.01); *A47C 13/005* (2013.01); *A47C 17/02* (2013.01); *A47C 17/04* (2013.01)

(58) Field of Classification Search

CPC ..... A47C 4/022; A47C 1/031; A47C 13/005; A47C 17/02; A47C 17/04

USPC ..... 297/440.14

See application file for complete search history.

(56) References Cited

U.S. PATENT DOCUMENTS

| | | | | | |
|---|---|---|---|---|---|
| 2,522,404 | A | | 9/1950 | Siebelist | |
| 2,710,650 | A | | 6/1955 | Sowder | |
| 3,185,179 | A | * | 5/1965 | Haraautuneian | A61M 39/223 137/625.47 |
| 3,387,341 | A | * | 6/1968 | Mates | A44B 18/00 24/10 R |
| 3,836,698 | A | * | 9/1974 | Bawa | H02G 3/02 16/2.2 |
| 4,141,590 | A | | 2/1979 | Lafer | |
| 4,421,356 | A | | 12/1983 | Singer | |
| 4,810,008 | A | * | 3/1989 | Brodie | F16L 55/1608 285/133.4 |
| 5,316,349 | A | * | 5/1994 | Rafeld | F16L 47/32 285/133.3 |
| 5,649,742 | A | | 7/1997 | Liu | |

(Continued)

*Primary Examiner* — Mark R Wendell

(74) *Attorney, Agent, or Firm* — Morgan, Lewis & Bockius LLP

(57) ABSTRACT

Disclosed are connectors, sofa chair frames and sofa chairs. A connector includes first and second members disposed in first and second directions, respectively. The first member includes a through hole along the first direction and a notch in the first direction on a peripheral wall of the first member to enhance an elasticity of the first member. The notch allows the through hole of the first member to couple with any one element in a plurality of first elements, where at least two elements in the plurality of first elements are different from each other. The second member has a first end coupled to a middle portion of the first member, and includes an opening recessed inwardly from a second end in the second direction to accommodate at least a portion of a second element.

21 Claims, 3 Drawing Sheets

(56) References Cited

U.S. PATENT DOCUMENTS 5,678,706 A * 10/1997 Husak ..... A47B 47/005 211/189
5,678,890 A * 10/1997 Tenbroeck ..... A47C 3/029 297/271.6
5,806,830 A * 9/1998 Alvarez ..... F16K 27/0218 251/145
5,964,252 A * 10/1999 Simmons ..... F16L 59/022 138/128
6,415,801 B1 * 7/2002 Gallegos ..... A45D 2/24 132/251
6,840,573 B1 1/2005 Yao
6,848,740 B1 2/2005 Reese
D504,271 S 4/2005 Springer
7,011,367 B2 3/2006 Riley
D553,894 S 10/2007 Springer
7,293,840 B1 * 11/2007 Schu ..... A47C 15/006 297/448.2
7,740,320 B2 6/2010 Chiang
8,038,211 B2 10/2011 Berk
8,870,290 B2 10/2014 Xu
D752,890 S 4/2016 Akkad
9,351,578 B2 5/2016 Homans
9,456,693 B1 10/2016 Broughton
D781,607 S 3/2017 Bittle
9,648,960 B2 5/2017 Scales
9,782,006 B2 10/2017 Arruda
9,986,834 B1 * 6/2018 Chen ..... A47C 1/12
2003/0127852 A1 * 7/2003 Usui ..... F02M 55/025 285/125.1
2005/0202393 A1 * 9/2005 Morgan ..... A47B 97/00 434/365
2005/0274298 A1 12/2005 Paulin
2006/0033367 A1 2/2006 Sweeney
2006/0284460 A1 12/2006 Tseng
2007/0052268 A1 3/2007 Daniels
2008/0048438 A1 * 2/2008 Weise ..... F16L 41/021 285/125.1
2008/0179471 A1 * 7/2008 Verdelli ..... A47B 91/06 248/188.9
2012/0146371 A1 6/2012 Cotton
2012/0326475 A1 12/2012 Campbell
2014/0049091 A1 2/2014 Gross
2017/0105544 A1 4/2017 Choi

* cited by examiner

CONNECTOR FOR SOFA CHAIR FRAME AND SOFA CHAIR FRAME HAVING SAME

CROSS-REFERENCE TO RELATED APPLICATION

The present application claims priority of Chinese Patent Application Number 201620811440.X filed Jul. 29, 2016, the entire contents of which are incorporated herein for all purposes by this reference.

FIELD OF THE INVENTION

The present invention generally relates to connectors and chairs. More particularly, the present invention relates to connectors, and sofa chair frames and sofa chairs having such connectors.

BACKGROUND

Chairs are a common furniture item. Some chairs are made of wood or bamboo. Such chairs are usually uncomfortable as their seats are stiff, and cold in the winter. Thus, in recent years, sofa chairs have become more and more popular.

However, some existing sofa chairs are made and pre-assembled in factories. Once out of the factories, they are usually fixed, and cannot be disassembled or re-assembled. As such, they are difficult to handle, require larger shipping and storage spaces, and increase transportation cost. Some other existing sofa chairs can be disassembled and re-assembled. These sofa chairs are usually complex, and inconvenient to assemble. In addition, the production cost and defect rate of these sofa chairs are relatively high.

Given the current state of the art, there remains a need for connectors, sofa chair frames and sofa chairs that address the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide connectors, sofa chair frames and sofa chairs disclosed below.

In many embodiments, the present invention provides a connector including a first member and a second member. The first member is disposed in a first direction. The first member includes a through hole along the first direction, and a notch in the first direction on a peripheral wall of the first member to enhance elasticity of the first member. The notch allows the through hole of the first member to couple with any one element in a plurality of first elements, wherein at least two first elements in the plurality of first elements are different from each other. The second member is disposed in a second direction different from the first direction and has a first end coupled to a middle portion of the first member. The second member includes an opening recessed inwardly from a second end in the second direction to accommodate at least a portion of a second element.

In an embodiment, the first and second members are formed integrally. In an embodiment, one or more of the first and second members are tubular. In an embodiment, the first and second directions are substantially perpendicular to each other. In an embodiment, the opening of the second member is tapered inwardly, with the opening becoming smaller toward the first end of the second member. In an embodiment, the connector is made of a plastic or a rubber.

In some embodiments, the connector further includes one or more ribs to enhance the strength of the connector. Each rib in the one or more ribs includes a first edge coupled to or formed with a peripheral wall of the first member substantially in the first direction and a second edge coupled to or formed with a peripheral wall of the second member substantially in the second direction. In an embodiment, the one or more ribs include two ribs disposed on opposite sides of the second member.

In various embodiments, the present invention provides a sofa chair frame. The sofa chair frame includes left and right bars disposed at left and right sides of the sofa chair frame, each having a front portion and a rear portion. The sofa chair frame also includes front and rear H-shaped support frames disposed below the front and rear portions of the left and right bars respectively. Each of the front and rear H-shaped support frames includes left and right legs connected by a lateral bar. The sofa chair frame further includes a plurality of connectors coupling the left and right bars with the front and rear H-shaped support frames. Each connector in the plurality of connectors includes a first member and a second member. The first member is disposed in a first direction, and includes a through hole along the first direction to couple with the front or rear portion of a respective bar in the left and right bars. The second member is disposed in a second direction different from the first direction and having a first end coupled to a middle portion of the first member. The second member includes an opening recessed inwardly from a second end in the second direction, and the opening accommodates an upper end portion of a corresponding leg in the left and right legs of the front and rear H-shaped support frames disposed below the front or rear portion of the respective bar.

In an embodiment, for one or more connectors in the plurality of connectors, each respective connector further includes one or more ribs to enhance the strength of the connector. Each rib in the one or more ribs includes a first edge coupled to or formed with a peripheral wall of the first member substantially in the first direction and a second edge coupled to or formed with a peripheral wall of the second member substantially in the second direction.

In some embodiments, for each respective connector in one or more connectors in the plurality of connectors, the first member includes a notch in the first direction on a peripheral wall of the first member to enhance an elasticity of the first member.

In some embodiments, for each respective connector in one or more connectors in the plurality of connectors, the opening of the second member is tapered inwardly, with the opening becoming smaller toward the first end of the second member.

In one embodiment, the rear H-shaped support frame is longer than the front H-shaped support frame such that each of the left and right bars is tilted upwardly with the front portions of the left and right bars positioned lower than the rear portions of the left and right bars.

In an embodiment, one or more of the left and right bars are tubular. In an embodiment, each of the left and right bars is arcuate. In an embodiment, the left and right bars are symmetric to each together. In an embodiment, each of the front left and right legs and the rear left and right legs is configured to have a lower portion bent outwardly with respect to a central vertical line of the sofa chair frame.

In some embodiments, the sofa chair frame further includes a plurality of elastic sheaths, each covering and protecting a lower end of the left or right leg of the front or rear H-shaped support frame.

In an embodiment, the sofa chair frame further includes a crossbar having a first end connected to the lateral bar of the front H-shaped support frame and a second end connected to the lateral bar of the rear H-shaped support frame.

In various embodiments, the present invention further provides a sofa chair including any one of the sofa chair frames disclosed herein.

The connectors, sofa chair frames and sofa chairs of the present invention have other features and advantages that will be apparent from or are set forth in more detail in the accompanying drawings, which are incorporated herein, and the following Detailed Description, which together serve to explain certain principles of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
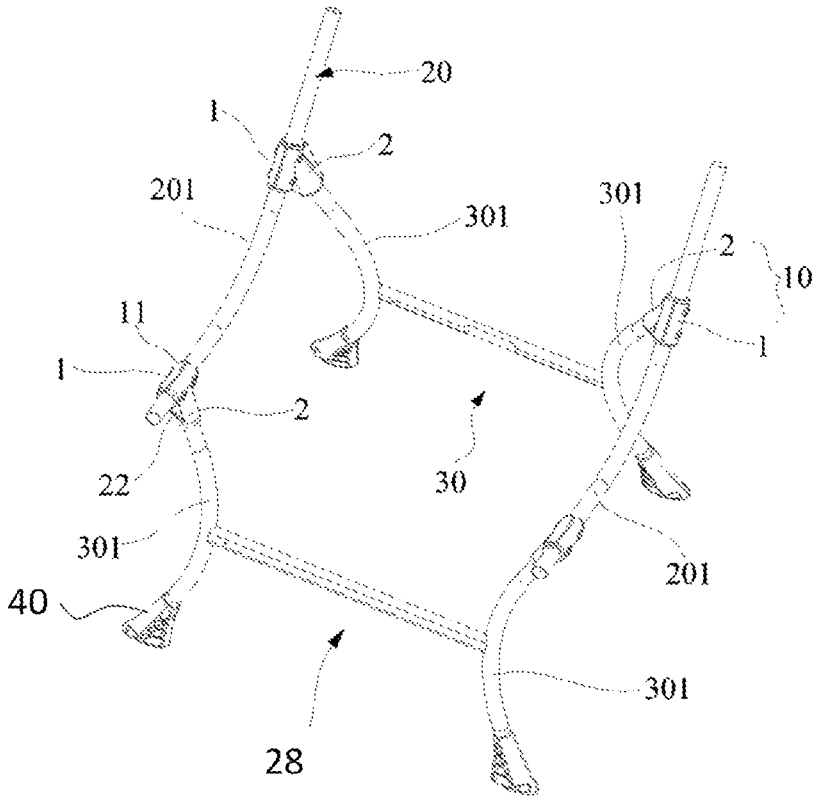
FIG. 1 is a schematic view illustrating an exemplary sofa chair frame in accordance with some embodiments of the present invention.

Reference will now be made in detail to implementations of the present application as illustrated in the accompanying drawings. The same reference indicators will be used throughout the drawings and the following detailed description to refer to the same or like parts. Those of ordinary skill in the art will realize that the following detailed description of the present application is illustrative only and is not intended to be in any way limiting. Other embodiments of the present application will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of this disclosure can be made without departing from its spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of connectors for connecting two or more elements of a chair frame, and chair frames having such connectors. The connectors and chair frames of the present invention can be of various sizes and shapes, and can be made of any suitable material.

Generally, a sofa chair frame includes bars, legs for supporting the bars and connectors for coupling the bars with the legs. As used herein, the term "a bar" refers to an elongated element including but not limited to a tube, a bar, a rod, a pipe or the like. A bar can be made of any suitable material including but not limited to metal (e.g., aluminum, cast iron) and plastic. Similarly, a leg can be made of any suitable material including but not limited to metal (e.g., aluminum, casted iron) and plastic. In an exemplary embodiment, the bars are disposed on the left and right sides of the sofa chair or chair frame, and configured to couple a cover/cushion to make a sofa chair. These components can be formed from one or more of the above-recited materials in any combination. An example of coupling the left and right bars with a cover/cushion is disclosed in US Publication No. 20170105544, the entire contents of which are incorporated herein for all purposes by this reference.

Figure 2:
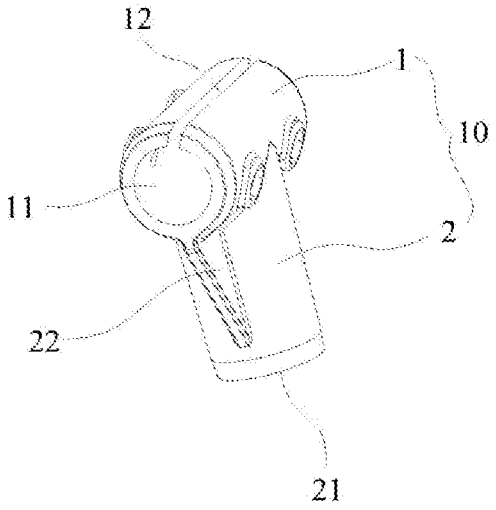
FIG. 2 is a schematic perspective view illustrating an exemplary connector in accordance with some embodiments of the present invention.
Figure 3:
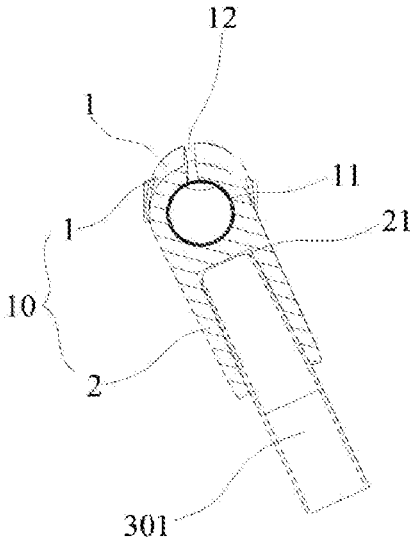
FIG. 3 is a schematic cut-off view illustrating the exemplary connector of FIG. 2 coupled with a leg of a sofa chair frame in accordance with some embodiments of the present invention.

Referring now to FIGS. 1-3, there is depicted an exemplary sofa chair frame in accordance with some embodiments of the present invention. The sofa chair frame includes left and right bars 20 disposed at left and right sides of the sofa chair frame. Each of the left and right bars includes a front portion and a rear portion. In many embodiments, left and right bars 20 are similar to or substantially the same as each other and disposed symmetrically with respect to a central plane of the chair frame. In some embodiments, one or each of left and right bars 20 is arcuate, e.g., arched or bent lengthwise. In some embodiments, one or more of the left and right bars are tubular.

The sofa chair frame also includes a plurality of legs 301 disposed below the front and rear portions of the left and right bars to support the left and right bars. In the illustrated embodiment, the two front legs are connected by a lateral bar to collectively form front H-shaped support frame 28, and the two rear legs are connected by a lateral bar to collectively form rear H-shaped support frame 30. It should be noted that while the reference numeral 301 is used to designate all of the legs, one leg can be configured the same or differently from the other leg in terms of the shape, length, material of which the leg is made, or the like. For instance, in some embodiments, the rear H-shaped support frame is longer (e.g. taller when the chair is placed upwardly) than the front H-shaped support frame, e.g., the left and right rear legs are longer than the left and right front legs. Accordingly, each of the left and right bars is tilted upwardly with the front portions of the left and right bars positioned lower than the rear portions of the left and right bars. In such embodiments, the lower front portions of the left and right bars can be used as an armrest while the upward tilted rear portions of the left and right bars can be used to make a backrest. In some embodiments, for stabilization, aesthetic or other purposes, each of the front left and right legs and the rear left and right legs is configured to have a lower portion bent outwardly with respect to a central vertical line of the sofa chair frame.

The plurality of legs 301 are connected to left and right bars 20 via a plurality of connectors 10. For instance, the left and right legs of the front H-shaped support frame are connected with the front portions of the left and right bars by the connector at the left-front side and the connector at the right-front side of the chair frame, respectively. Similarly, the left and right legs of the rear H-shaped support frame are connected with the rear portions of the left and right bars by the connector at the left-rear side and the connector at the right-rear side of the chair frame, respectively. The connectors of the present invention can be made of any suitable material including but not limited to plastic and rubber.

In general, a connector of the present invention includes two or more members disposed in different directions and coupled (e.g., connected, joined or integrally formed) with each other. Each member is configured to engage with an element (e.g., a bar, a leg of a chair). For instance, FIGS. 2 and 3 illustrate connector 10 including first member 1 and second member 2. The first and second members are disposed in two different directions, e.g., the first member in a first direction and the second member in a different second direction. In an embodiment, a first end of the second member is coupled with a middle portion of the first member. In an embodiment, the first and second members are coupled to each other such that the first and second directions are substantially perpendicular to each other. In some embodiments, one or more of the first and second members are tubular.

The first member is configured to couple with a first element (e.g., a bar or a leg) and the second member is configured to couple with a second element (e.g., a bar or a leg). For instance, in many embodiments, the first member is formed with a through hole, such as through hole 11, along the first direction to couple with the front or rear portion of the left or right bar (e.g., by sleeving or clamping onto the portion of the left or right bar). The second member is formed with an opening, such as opening 21, recessed inwardly in the second direction from a second end of the second member to accommodate an upper end portion of a corresponding leg. In an embodiment, the second end is opposite to the first end of the second member.

In some embodiments, the first member includes a notch such as notch 12 on a peripheral wall of the first member to enhance the elasticity of the first member. In an embodiment, notch 12 is a cut on the peripheral wall of the first member along the first direction. Notch 12 makes the first member more flexible and more adaptable. With a notch, the first member can accommodate a variety of elements such as bars having different shapes or different dimensions (e.g., widths, diameters). As such, it illuminates the needs to have a variety of dies each for making a particular connector suitable for a specific element (e.g., a specific bar at a specific configuration). Therefore, it reduces manufacturing cost significantly. Moreover, it makes the assembling and disassembling of the chair or chair frame easy and convenient. Further, once the first member is coupled with the desired element, the notch allows the first member to adapt and couple with the desired element firmly/tightly.

Figure 4:
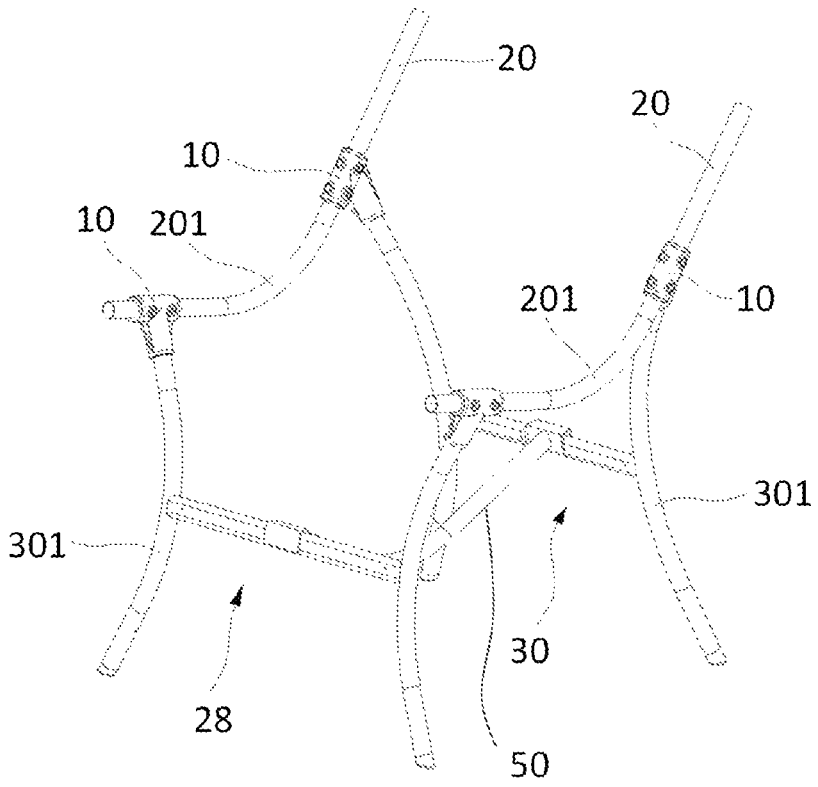
FIG. 4 is a schematic view illustrating an exemplary sofa chair frame with additional, optional or alternative elements in accordance with some embodiments of the present invention.

It should be noted, however, a sofa chair or a chair frame of the present invention can include a connector without a notch. For instance, FIG. 4 illustrates a sofa chair frame, in which the left and right bars are coupled with the legs by connectors without a notch.

In some embodiments, opening 21 of the second member is tapered inwardly, with the opening becoming smaller toward the first end of the second member. As used herein, the term "tapered" refers to the decrease of at least one dimension of the opening (e.g., a cross-sectional width or diameter) as it recesses inwardly. The tapered opening allows easy insertion of the desired element, e.g., the upper end portion of a leg. When the chair is in use, the tapered opening (at least the inner and narrower portion towards the first end of the second member) tightly and firmly encases the upper end portion of the leg. As such, the chair or chair frame is strong and stable.

In some embodiments, connector 10 includes one or more ribs such as rib 22 to enhance the strength of the connector. Rib 22 includes a first edge coupled to or formed with a peripheral wall of the first member substantially in the first direction and a second edge coupled to or formed with a peripheral wall of the second member substantially in the second direction. In an embodiment, connector 10 includes two ribs disposed on opposite sides of the second member.

It should be noted that while the reference numeral 10 is used to designate all of the connectors connecting the bars and the legs, one connector can be configured the same or differently from the other connector in terms of the shape, size, or the like. For example, if desired, one connector (e.g., the connector at the left-front side) can be configured to have the first and second members disposed at a first angle (e.g., 90 degrees, perpendicular to each other), where another connector (e.g., the connector at the left-rear side) can be configured to have the first and second members disposed at a second angle (e.g., an angle other than 90 degrees). As another example, if desired, the openings of the second members of different connectors can have different diameters or depths to accommodate different legs. As a further example, if desired, one connector can have a notch while the other connector cab be without a notch.

Referring to FIGS. 1 and 4, in some embodiments, a sofa chair or a sofa chair frame includes one or more additional or optional elements. For instance, in the embodiment illustrated in FIG. 1, the chair frame includes a plurality of elastic sheaths 40, each covering and protecting a lower end (e.g., the base) of the left or right leg of the front or rear H-shaped support frame. Sheaths can be made of any suitable material including but not limited to plastic and rubber. As another example, FIG. 4 illustrates the chair frame including crossbar 50. Crossbar 50 has a first end connected to the lateral bar of the front H-shaped support frame and a second end connected to the lateral bar of the rear H-shaped support frame. Crossbar 50 further stabilizes the chair or the chair frame when in use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. The terms "left" or "right", "front" or "rear", "upper" or "lower", and etc. are used to describe features of the exemplary embodiments with reference to the positions of such features as displayed in the figures.

What is claimed is:

1. A connector comprising:

a first member disposed in a first direction and comprising:

a through hole along the first direction; and a notch in the first direction on a peripheral wall of the first member to enhance an elasticity of the first member, thereby allowing the through hole of the first member to couple with any one element in a plurality of elements, wherein each respective element in the plurality of elements is a bar of a corresponding chair frame in a plurality of chair frames, and wherein at least two elements in the plurality of elements are different from each other; and a second member in a second direction different from the first direction and having a first end coupled to a middle portion of the first member, wherein the second member comprises an opening recessed inwardly from a second end in the second direction, thereby forming a blind hole to accommodate an upper end portion of a leg of the corresponding chair frame in the plurality of chair frames, wherein when assembled, the upper end portion of the leg abuts a bottom of the blind hole, thereby supporting the bar of the corresponding chair frame in the plurality of chair frames.

2. The connector of claim 1, wherein the first and second members are formed integrally.

3. The connector of claim 1, wherein one or more of the first and second members are tubular.

4. The connector of claim 1, wherein the first and second directions are substantially perpendicular to each other.

5. The connector of claim 1, wherein the opening of the second member is tapered inwardly, with the opening becoming smaller toward the first end of the second member.

6. The connector of claim 1, further comprising:

one or more ribs to enhance a strength of the connector, wherein each rib in the one or more ribs comprises a first edge coupled to or formed with a peripheral wall of the first member substantially in the first direction and a second edge coupled to or formed with a peripheral wall of the second member substantially in the second direction.

7. The connector of claim 6, wherein the one or more ribs comprise two ribs disposed on opposite sides of the second member.

8. The connector of claim 1, wherein the connector is made of a material comprising a plastic or a rubber.

9. A sofa chair frame, comprising:

left and right bars disposed at left and right sides of the sofa chair frame, each having a front portion and a rear portion;

front and rear H-shaped support frames disposed below the front and rear portions of the left and right bars respectively, wherein each of the front and rear H-shaped support frames comprises left and right legs connected by a lateral bar; and a plurality of connectors coupling the left and right bars with the front and rear H-shaped support frames, wherein each connector in the plurality of connectors comprises:

a first member in a first direction, and comprising a through hole along the first direction to sleeve on the front or rear portion of a respective bar in the left and right bars; and a second member in a second direction different from the first direction and having a first end coupled to a middle portion of the first member, wherein the second member comprises an opening recessed inwardly from a second end in the second direction, and the opening accommodates an upper end portion of a corresponding leg in the left and right legs of the front and rear H-shaped support frames disposed below the front or rear portion of the respective bar.

10. The sofa chair frame of claim 9, wherein for one or more connectors in the plurality of connectors, each respective connector further comprises:

one or more ribs to enhance a strength of the connector, wherein each rib in the one or more ribs comprises a first edge coupled to or formed with a peripheral wall of the first member substantially in the first direction and a second edge coupled to or formed with a peripheral wall of the second member substantially in the second direction.

11. The sofa chair frame of claim 9, wherein for each respective connector in one or more connectors in the plurality of connectors, the first member comprises a notch in the first direction on a peripheral wall of the first member to enhance an elasticity of the first member.

12. The sofa chair frame of claim 9, wherein for each respective connector in one or more connectors in the plurality of connectors, the opening of the second member is tapered inwardly, with the opening becoming smaller toward the first end of the second member.

13. The sofa chair frame of claim 9, wherein the rear H-shaped support frame is longer than the front H-shaped support frame such that each of the left and right bars is tilted upwardly with the front portions of the left and right bars positioned lower than the rear portions of the left and right bars.

14. The sofa chair frame of claim 9, wherein one or more of the left and right bars are tubular.

15. The sofa chair frame of claim 9, wherein each of the left and right bars is arcuate.

16. The sofa chair frame of claim 9, wherein the left and right bars are symmetric to each together.

17. The sofa chair frame of claim 9, wherein each of the front left and right legs and the rear left and right legs is configured to have a lower portion bent outwardly with respect to a central vertical line of the sofa chair frame.

18. The sofa chair frame of claim 9, further comprising:

a plurality of elastic sheaths, each covering and protecting a lower end of the left or right leg of the front or rear H-shaped support frame.

19. The sofa chair frame of claim 9, further comprises:

a crossbar having a first end connected to the lateral bar of the front H-shaped support frame and a second end connected to the lateral bar of the rear H-shaped support frame.

20. A sofa chair comprising the sofa chair frame of claim 9.

21. The sofa chair frame of claim 9, wherein of each connector in the plurality of connectors, the opening of the second member forms a blind hole, wherein when assembled, the upper end portion of the correspond leg abuts a bottom of the blind hole, thereby supporting the left or right bar of the sofa chair frame.

* * * * *